US012291423B2

(12) United States Patent
Okumura

(10) Patent No.: US 12,291,423 B2
(45) Date of Patent: May 6, 2025

(54) MEDIUM CONVEYING APPARATUS TO SET TORQUE OF MOTOR ACCORDING TO POSITION OF MEDIUM TRAY

(71) Applicant: PFU LIMITED, Kahoku (JP)

(72) Inventor: Hideyuki Okumura, Kahoku (JP)

(73) Assignee: PFU LIMITED, Kahoku (JP)

( * ) Notice: Subject to any disclaimer, the term of this patent is extended or adjusted under 35 U.S.C. 154(b) by 192 days.

(21) Appl. No.: 18/153,206

(22) Filed: Jan. 11, 2023

(65) Prior Publication Data

US 2023/0257224 A1 Aug. 17, 2023

(30) Foreign Application Priority Data

Feb. 16, 2022 (JP) ..... 2022-022233

(51) Int. Cl.
*B65H 1/18* (2006.01)
*B65H 1/14* (2006.01)
*B65H 7/20* (2006.01)

(52) U.S. Cl.
CPC ..... *B65H 7/20* (2013.01); *B65H 1/14* (2013.01); *B65H 1/18* (2013.01); *B65H 2403/92* (2013.01)

(58) Field of Classification Search
CPC ..... B65H 1/18; B65H 2515/32; B65H 1/08
See application file for complete search history.

(56) References Cited

U.S. PATENT DOCUMENTS 7,568,850 B2 * 8/2009 Bingham ..... B41J 13/103 271/145

FOREIGN PATENT DOCUMENTS

| | | | | |
|---|---|---|---|---|
| JP | 2003-300659 A | | 10/2003 | |
| JP | 2012-12138 A | | 1/2012 | |
| JP | 2017043463 A | * | 3/2017 | |
| WO | WO-2017149802 A1 | * | 9/2017 | ..... H04N 1/00005 |

* cited by examiner

*Primary Examiner* — Howard J Sanders
(74) *Attorney, Agent, or Firm* — WOMBLE BOND DICKINSON (US) LLP

(57) ABSTRACT

A medium conveying apparatus includes a motor, a medium tray, a roller, and a processor to control the motor so that the medium tray is located at a position at which the medium placed on the uppermost side of the media placed on the medium tray abuts on the roller each time a particular number of media of the media placed on the medium tray is conveyed, and detect a position of the placing surface. The processor sets the torque of the motor to a first torque when a position of the placing surface is a first position, and sets the torque of the motor to a second torque smaller than the first torque when a position of the placing surface is a second position above the first position.

15 Claims, 15 Drawing Sheets

MEDIUM CONVEYING APPARATUS TO SET TORQUE OF MOTOR ACCORDING TO POSITION OF MEDIUM TRAY

CROSS-REFERENCE TO RELATED APPLICATIONS

This application is based upon and claims the benefit of priority of prior Japanese Patent Application No. 2022-022233, filed on Feb. 16, 2022, the entire contents of which are incorporated herein by reference.

TECHNICAL FIELD

Embodiments described in the present specification relate to conveying a medium.

BACKGROUND

In the so-called top-first type medium conveying apparatus in which media placed on a medium tray are conveyed in order from the upper side, a function of raising the medium tray each time a constant number of media is conveyed, has been developed so that a plurality of media placed on the medium tray can be continuously conveyed.

A paper accommodating apparatus which includes a power supply to supply a current to a driving motor for driving a lifting means for raising and lowering a loading means for stacking papers, and an abutting member provided above the loading means to abut on a paper stacked on the loading means raised by the lifting means, is disclosed (see Japanese Unexamined Patent Publication No. 2012-012138). The paper accommodating apparatus stops raising the loading means by the lifting means based on a detection result of a value of an electric current flowing through the driving motor when the loading means on which the papers are stacked is raised by the lifting means driven by the driving motor.

A sheet processing apparatus to detect whether or not a present position of a loading means on which sheets are stacked is a predetermined position, based on a detection of a lifting amount by a driving means for raising and lowering the loading means, is disclosed (see Japanese Unexamined Patent Publication No. 2003-300659).

SUMMARY

According to some embodiments, a medium conveying apparatus includes a motor in which a setting of a torque can be changed according to a supplied power, a medium tray provided so as to be raised and including a placing surface, a roller to abut on a medium placed on the uppermost side of media placed on the medium tray to convey the medium, and a processor to control the motor so that the medium tray is located at a position at which the medium placed on the uppermost side of the media placed on the medium tray abuts on the roller each time a particular number of media of the media placed on the medium tray is conveyed, and detect a position of the placing surface. The processor sets the torque of the motor to a first torque when a position of the placing surface is a first position, and sets the torque of the motor to a second torque smaller than the first torque when a position of the placing surface is a second position above the first position.

According to some embodiments, a medium conveying method includes conveying a medium by a roller to abut on a medium placed on the uppermost side of media placed on a medium tray provided so as to be raised and including a placing surface, controlling a motor in which a setting of a torque can be changed according to a supplied power so that the medium tray is located at a position at which the medium placed on the uppermost side of the media placed on the medium tray abuts on the roller each time a particular number of media of the media placed on the medium tray is conveyed, and detecting a position of the placing surface. The torque of the motor is set to a first torque when a position of the placing surface is a first position, and the torque of the motor is set to a second torque smaller than the first torque when a position of the placing surface is a second position above the first position.

According to some embodiments, a computer-readable, non-transitory medium storing a computer program causes a medium conveying apparatus including a motor in which a setting of a torque can be changed according to a supplied power, a medium tray provided so as to be raised and including a placing surface, a roller to abut on a medium placed on the uppermost side of media placed on the medium tray to convey the medium, to execute a process. The process includes controlling the motor so that the medium tray is located at a position at which the medium placed on the uppermost side of the media placed on the medium tray abuts on the roller each time a particular number of media of the media placed on the medium tray is conveyed, and detecting a position of the placing surface. The torque of the motor is set to a first torque when a position of the placing surface is a first position, and the torque of the motor is set to a second torque smaller than the first torque when a position of the placing surface is a second position above the first position.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a medium conveying method, and a computer-readable, non-transitory medium storing the computer program according to an embodiment, will be described with reference to the drawings. However, it should be noted that the technical scope of the invention is not limited to these embodiments, and extends to the inventions described in the claims and their equivalents.

Figure 1:
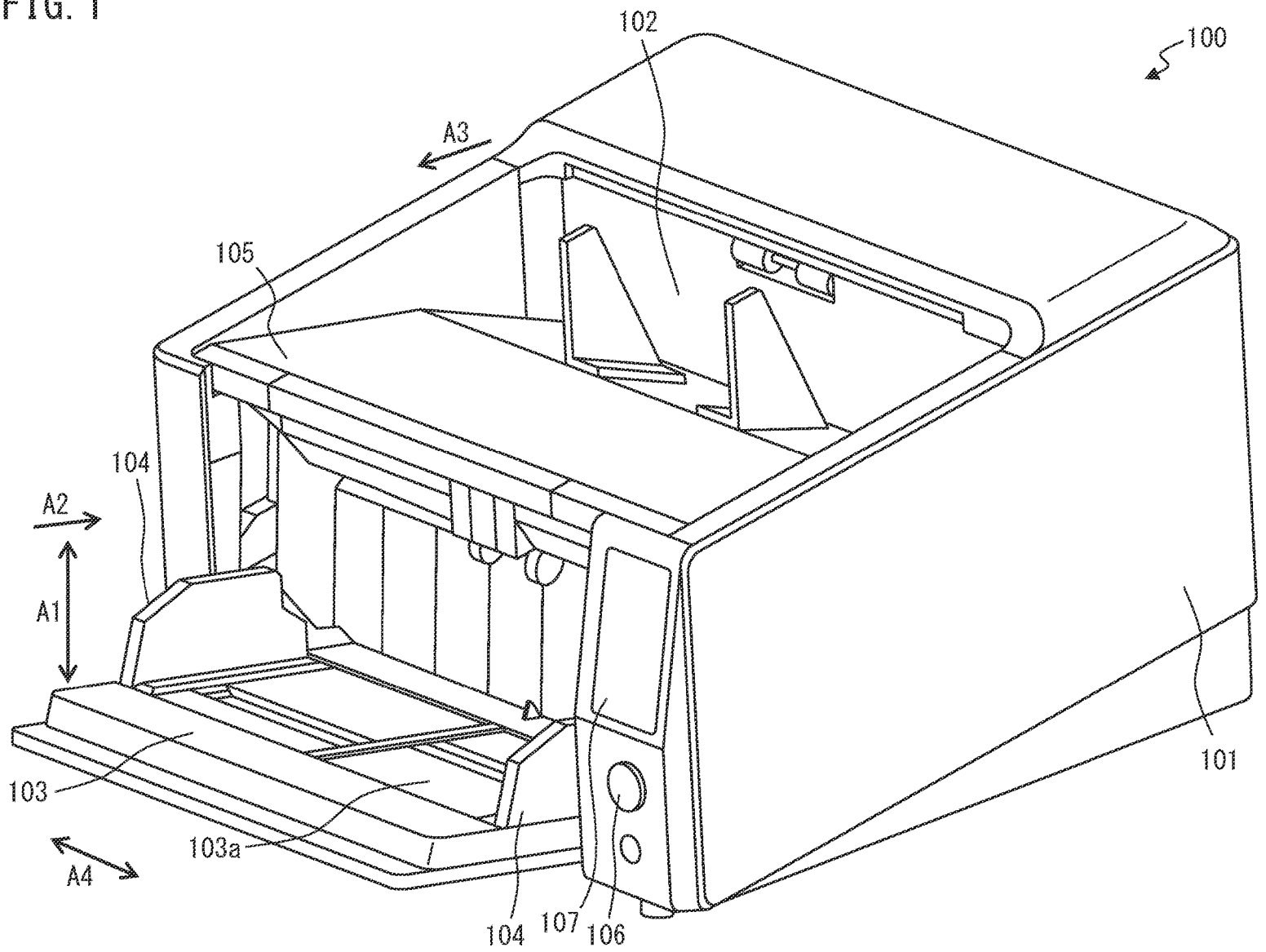
FIG. 1 is a perspective view illustrating a medium conveying apparatus 100.
Figure 2:
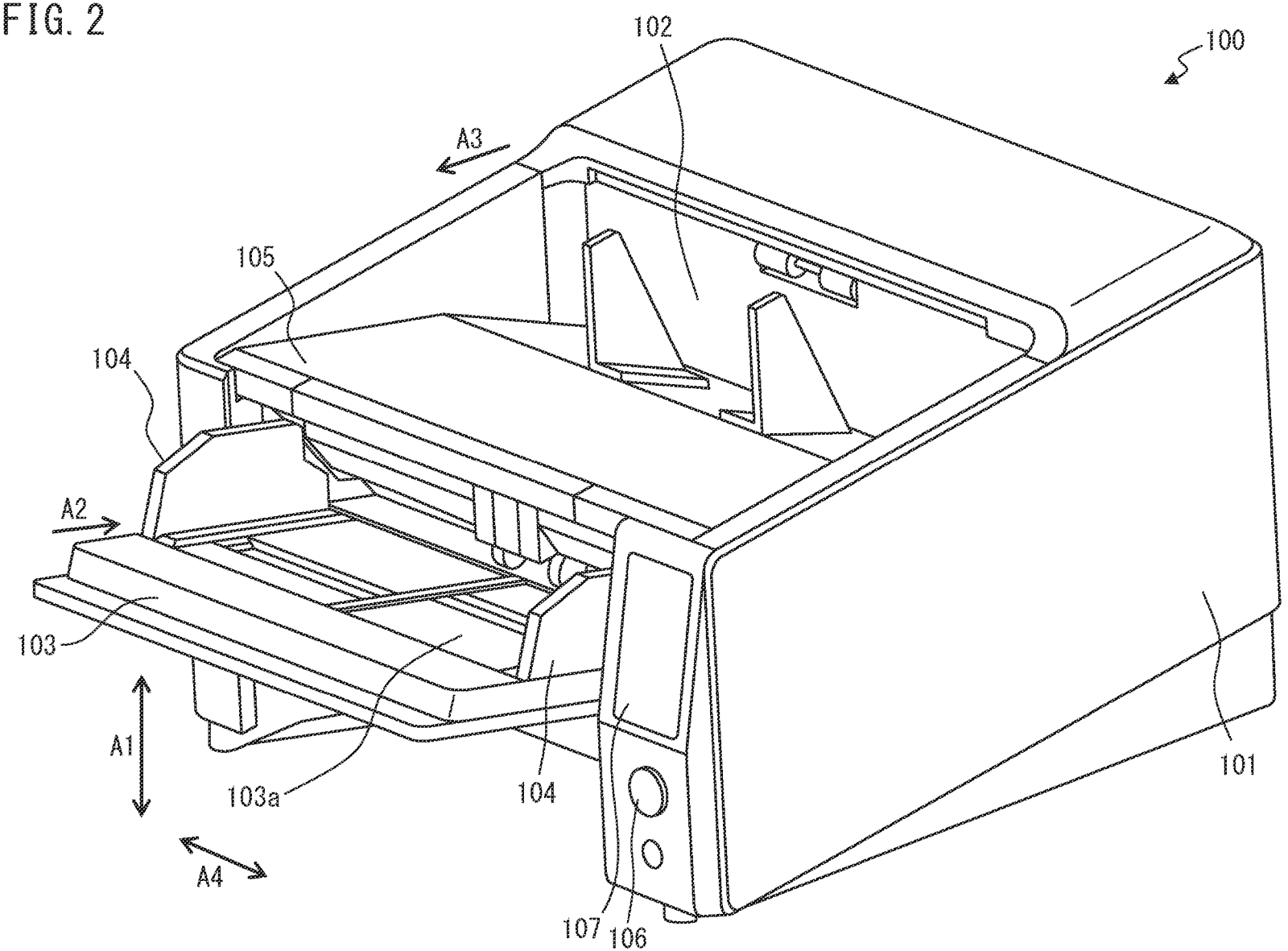
FIG. 2 is a perspective view illustrating the medium conveying apparatus 100.

FIGS. 1 and 2 are perspective views illustrating a medium conveying apparatus 100 configured as an image scanner. The medium conveying apparatus 100 conveys and images a medium being a document. The medium is a paper, a thick paper, a card, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

In FIGS. 1 and 2, an arrow A1 indicates a substantially vertical direction (height direction), an arrow A2 indicates a medium conveying direction, an arrow A3 indicates a medium ejecting direction, and an arrow A4 indicates a width direction perpendicular to the medium conveying direction A2 or the medium ejecting direction A3. Hereinafter, upstream refers to upstream of the medium conveying direction A2 or the medium ejecting direction A3, downstream refers to downstream of the medium conveying direction A2 or the medium ejecting direction A3.

The medium conveying apparatus 100 includes a first housing 101, a second housing 102, a medium tray 103, a side guide 104, an ejection tray 105, an operation device 106 and a display device 107, etc.

The first housing 101 and the second housing 102 are an example of a housing. The second housing 102 is located inside the first housing 101, and is rotatably engaged with the first housing 101 by hinges so as to be opened and closed at time of medium jam, or during cleaning the inside of the medium conveying apparatus 100, etc.

The medium tray 103 is a so-called hopper, includes a placing surface 103*a*, and is engaged with the first housing 101 so as to be able to place the conveyed medium. The medium tray 103 is provided on a side surface of the medium supply-side of the first housing 101 and the second housing 102 so as to be moved in the height-direction A1, i.e. so as to be raised and lowered. As shown in FIG. 1, the medium tray 103 is located at a position of a lower end so that the medium is easily placed when the medium is not conveyed. Hereinafter, as shown in FIG. 1, the position of the medium tray 103 when the medium is not conveyed and on which the user can place the medium, may be referred to as an initial position. On the other hand, as shown in FIG. 2, the medium tray 103 is raised to a position at which the medium placed on the uppermost side abuts on a pick roller to be described later when the medium is conveyed. In FIG. 2, the medium is not shown, in order to enhance the visibility. Hereinafter, as shown in FIG. 2, the position of the medium tray 103 at which the medium placed on the uppermost side abuts on the pick roller, and at which the medium can be conveyed, may be referred to as a conveying position.

The side guide 104 is provided on the placing surface 103*a* of the medium tray 103, so as to be moved in the width direction A4. The side guide 104 is positioned to match the width of the medium placed on the medium tray 103, to regulate the width direction of the medium. In the example illustrated in FIG. 1, two side guides 104 are spaced and located along in the width direction A4. The number of side guide 104 may be one.

The ejection tray 105 is formed on the second housing 102. The ejection tray 105 places the medium ejected from an ejection port of the first housing 101 and the second housing 102.

The operation device 106 includes an input device such as a button, and an interface circuit for acquiring a signal from the input device, receives an input operation by a user, and outputs an operation signal based on the input operation by the user. The display device 107 includes a display including a liquid crystal or organic electro-luminescence (EL), and an interface circuit for outputting image data to the display, and displays the image data on the display. The display device 107 may be a liquid crystal display with a touch panel function. In that case, the operation device 106 includes an interface circuit for acquiring an input signal from the touch panel.

Figure 3:
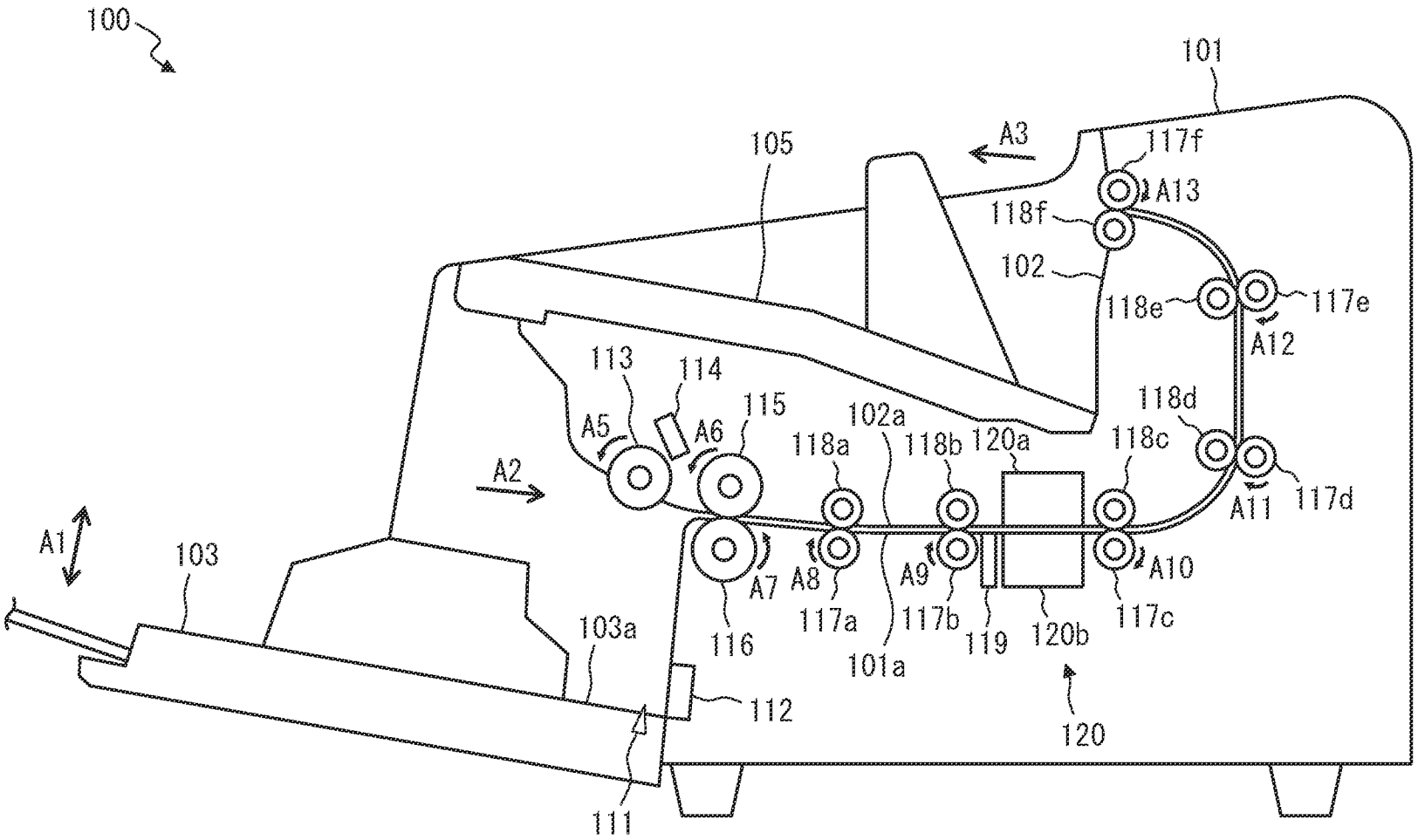
FIG. 3 is a diagram for illustrating a conveyance path inside the medium conveying apparatus 100.

FIG. 3 is a diagram for illustrating a conveyance path inside the medium conveying apparatus 100.

The conveying path inside the medium conveying apparatus 100 includes a first medium sensor 111, a medium tray sensor 112, a pick roller 113, a pick roller sensor 114, a feed roller 115, a separation roller 116, first to sixth conveying rollers 117*a* to 117*f*, first to sixth driven rollers 118*a* to 118*f*, a second medium sensor 119, and an imaging device 120, etc.

The number of each of the pick roller 113, the feed roller 115, the separation roller 116, the first to sixth conveying rollers 117*a* to 117*f*, and/or the first to sixth driven rollers 118*a* to 118*f* is not limited to one, and may be plural. In that case, a plurality of feed rollers 115, separation rollers 116, first to sixth conveying rollers 117*a* to 117*f*, and/or first to sixth driven rollers 118*a* to 118*f* are spaced and located along in the width direction A4, respectively.

The surface of the first housing 101 facing the second housing 102 forms a first guide 101*a* of the medium conveyance path, and the surface of the second housing 102 facing the first housing 101 forms a second guide 102*a* of the medium conveyance path.

The first medium sensor 111 is located on the medium tray 103, i.e., on the upstream side of the feed roller 113 and the separation roller 114, to detect a placing state of the medium in the medium tray 103. The first medium sensor 111 determines whether or not the medium is placed on the medium tray 103, by a contact detection sensor to pass a predetermined current when a medium is in contact or a medium is not in contact. The first medium sensor 111 generates and outputs a first medium signal of which the signal value changes between a state in which a medium is placed on the medium tray 103 and a state in which a medium is not placed. The first medium sensor 111 is not limited to the contact detection sensor, and any other sensor, such as a light detection sensor, capable of detecting the presence or absence of the medium may be used as the first sensor 111.

The pick roller 113 is an example of a roller. The pick roller 113 is provided in the second housing 102, and abuts on a medium placed on the uppermost side of media placed on the medium tray 103 lifted to a height substantially equal to that of the medium conveyance path to convey the medium to the downstream side.

The feed roller 115 is located in the secondary housing 102, and on the downstream side of the pick roller 113, to feed the medium placed on the medium tray 103 and fed by the pick roller 113 toward the further downstream side. The separation roller 116 is located in the first housing 101, to face the feed roller 115. The separation roller 116 is a so-called brake roller or retard roller, and is provided so as to rotate in a direction opposite to the medium feeding direction, or stop. The feed roller 115 and the separate roller 116 perform a medium separation operation to separate the media and feed them one by one. The feeding roller 115 is located on the upper side with respect to the separation roller 116. The medium conveying apparatus 100 feeds the medium by a so-called top-first type.

The first to sixth conveying rollers 117*a* to 117*f* and the first to sixth driven roller 118*a* to 118*f* are provided on the downstream side of the feed roller 115 and the separation roller 116, to face each other, respectively, and convey the medium fed by the feeding roller 115 and the separation roller 116 toward the downstream side. The sixth conveying roller 117*f* and the sixth driven roller 118*f* eject the medium to the ejection tray 105.

The second medium sensor 119 detects the medium conveyed to the arrangement position. The second medium sensor 119 is located on the downstream side of the second conveying roller 117*b*, i.e., on the downstream side of the feeding roller 115 and on the upstream side of the imaging device 120 in the medium conveying direction A2. The second medium sensor 119 includes a light emitter and a light receiver provided on one side with respect to the medium conveyance path, and a light guide tube provided at a position facing the light emitter and the light receiver across the medium conveyance path. The light emitter is a light emitting diode (LED), etc., and emits light toward the medium conveyance path. The light receiver is a photodiode, etc., and receives the light emitted by the light emitter, and guided by the light guide. The second medium sensor 119 generates and outputs a second medium signal of which signal value changes between a state in which a medium exists at a position of the second medium sensor 119 and a state in which a medium does not exist at the position, based on an intensity of the light received by the light receiver.

The second medium sensor 119 may be located on the upstream side of the second conveying roller 117*b* or the first conveying roller 117*a*. Further, reflecting member such as a mirror may be used, Instead of the light guide. Further, the light emitter and the light receiver may be provided to face each other across the medium conveyance path. The secondary medium sensor 119 may detect the presence of the medium by a contact detection sensor, etc., to pass a predetermined current when a medium is in contact or a medium is not in contact.

The imaging device 120 is located on the downstream side of the first to second conveying rollers 117*a* to 117*b* in the medium conveying direction A2, to image the medium conveyed by the first to second conveying rollers 117*a* to 117*b* and the first to second driven rollers 118*a* to 118*b*. The imaging device 120 includes a first imaging device 120*a* and a second imaging device 120*b* located to face each other across the medium conveyance path.

The first imaging device 120*a* includes a line sensor based on a unity-magnification optical system type contact image sensor (CIS) including an imaging element based on a complementary metal oxide semiconductor (CMOS) linearly located in a main scanning direction. Further, the first imaging device 120*a* includes a lens for forming an image on the imaging element, and an A/D converter for amplifying and analog-digital (A/D) converting an electric signal output from the imaging element. The first imaging device 120*a* generates and outputs an input image by imaging a front side of the conveyed medium.

Similarly, the second imaging device 120*b* includes a line sensor based on a unity-magnification optical system type CIS including an imaging element based on a CMOS linearly located in a main scanning direction. Further, the second imaging device 120*b* includes a lens for forming an image on the imaging element, and an A/D converter for amplifying and A/D converting an electric signal output from the imaging element. The second imaging device 120*b* generates and outputs an input image by imaging a back side of the conveyed medium.

Only either of the first imaging device 120*a* and the second imaging device 120*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed in the medium conveying direction A2 between the first guide 101*a* and the second guide 102*a* by the pick roller 113 rotating in a medium feeding direction A5 and the feed roller 115 rotating in a medium feeding direction A6. The medium conveying apparatus 100 has a separation mode in which media are separated to feed, and a non-separation mode in which media is fed without separating, as a feeding mode. The feeding mode is set by using the operation device 106 or an information processing apparatus in communication with the medium conveying apparatus 100, by the user. When the feeding mode is set to the separation mode, the separation roller 116 rotates in a direction of an arrow A7, i.e., in a direction opposite to the medium feeding direction, or stops. Consequently, feeding of a medium other than the separated medium is restricted (prevention of multi-feed). On the other hand, when the feeding mode is set to the non-separation mode, the separation roller 116 rotates in the opposite direction of the arrow A7, i.e., the medium feeding direction.

The medium is fed to an imaging position of the imaging device 120 while being guided by the first guide 101*a* and the second guide 102*a*, by the first to second conveying rollers 117*a* to 117*b* rotating in directions of arrows A8 to A9, respectively, and is imaged by the imaging device 120. The medium is ejected on the ejection tray 105 by the third to sixth conveying rollers 117*c* to 117*f* rotating in directions of arrows A10 to A15, respectively.

Figure 4:
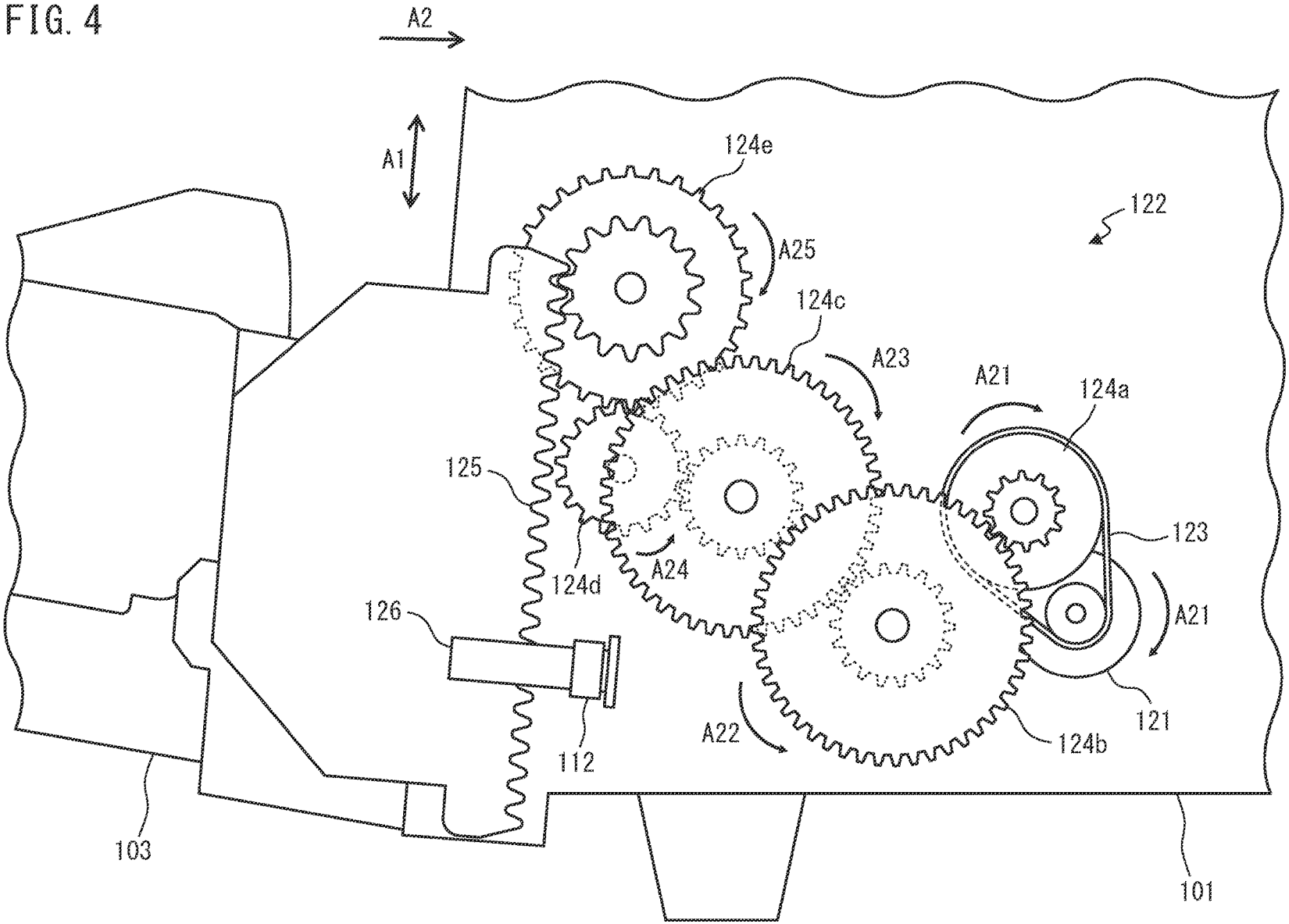
FIG. 4 is a schematic diagram for illustrating a driving mechanism, etc., of a medium tray 103

FIG. 4 is a schematic diagram for illustrating a driving mechanism and the medium tray sensor 112 of the medium tray 103.

As shown in FIG. 4, the medium conveying apparatus 100 further includes a first motor 121 and a transmission mechanism 122.

The first motor 121 is an example of a motor, and generates a first driving force for raising the medium tray 103 and a second driving force for lowering the medium tray 103, by a control signal from the processing circuit to be described later. The first motor 121 is provided so that a setting of a torque can be changed according to a supplied power. The first motor 121 is, for example, a stepping motor.

Figure 5:
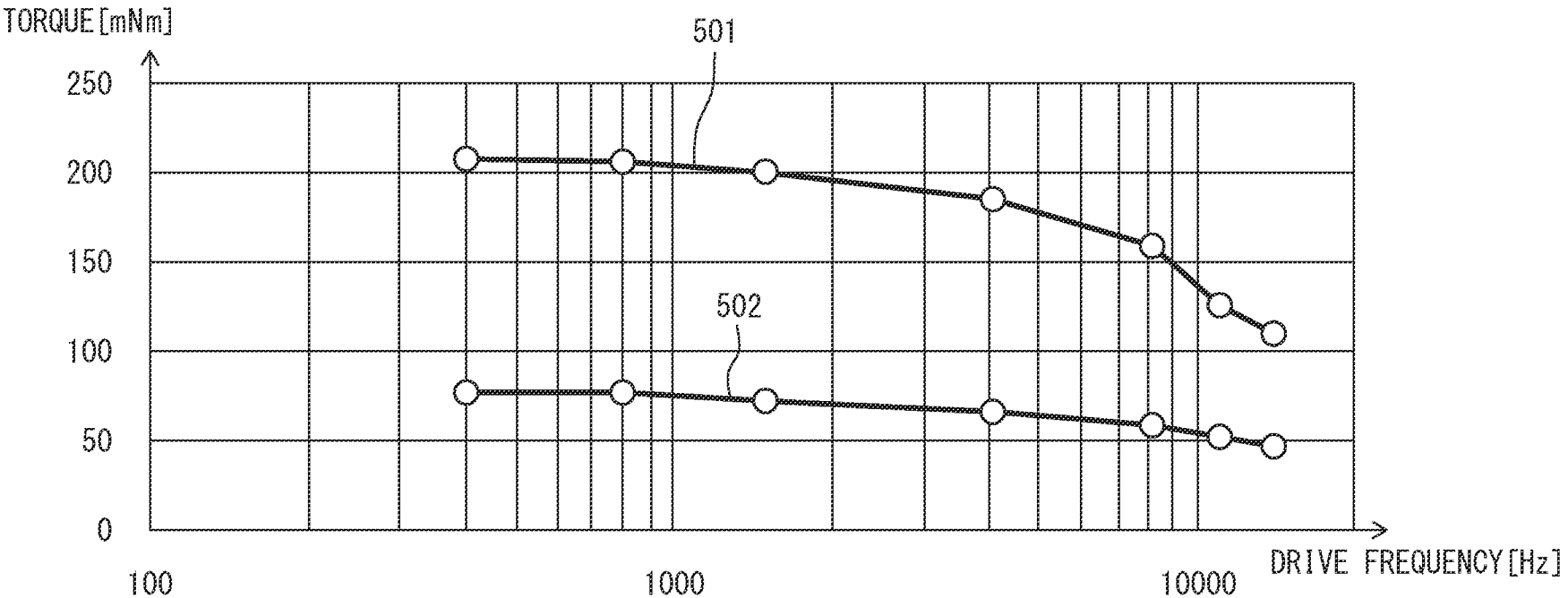
FIG. 5 is a graph for illustrating a torque of a stepping motor.

FIG. 5 is a graph for illustrating the torque of the stepping motor.

In FIG. 5, the horizontal axis indicates a drive frequency [Hz] of the stepping motor, and the vertical axis indicates the torque [mNm] of the stepping motor when the stepping motor is driven at the respective drive frequency. Graph 501 indicates the torque of the stepping motor when the current supplied to the stepping motor is 1.8 A. Graph 502 indicates the torque of the stepping motor when the current supplied to the stepping motor is 0.8 A. As shown in FIG. 5, the larger the drive frequency of the stepping motor is, i.e. the higher (faster) the rotation speed of the stepping motor is, the lower the torque of the stepping motor is. Conversely, the smaller the drive frequency of the stepping motor is, i.e., the lower (slower) the rotation speed of the stepping motor, the larger the torque of the stepping motor is.

Further, the larger the amount of the electric current supplied to the stepping motor, i.e., the larger the amount of the electric power supplied to the stepping motor, the larger the torque of the stepping motor is. Conversely, the smaller the amount of the electric current supplied to the stepping motor, i.e., the smaller the amount of the electric power supplied to the stepping motor, the smaller the torque of the stepping motor is. Therefore, the medium conveying apparatus 100 can change the torque of the first motor 121 by changing the amount of the electric power supplied to the first motor 121. The medium conveying apparatus 100 can increase the force applied to the medium tray 103 when moving the medium tray 103, by increasing the amount of the electric power supplied to the first motor 121, to increase the torque of the first motor 121. On the other hand, the medium conveying apparatus 100 can reduce the force applied to the medium tray 103 when moving the medium tray 103, by reducing the amount of electric power supplied to the first motor 121, to reduce the torque of the first motor 121.

The first motor 121 may be a motor other than the stepping motor, such as a DC (Direct-Current) motor, as long as it is a motor capable of changing the setting of the torque according to the supplied power.

The transmission mechanism 122 transmits the driving force from the first motor 121 to the medium tray 103. The transmission mechanism 122 includes a belt 123, first to fifth gear 124*a* to 124*c*, and rack 125, etc.

The belt 123 is stretched between a rotation shaft of the first motor 121 and a pulley portion of the first gear 124*a*. A gear portion of the first gear 124*a* is engaged with a larger gear portion of the second gear 124*b*. A smaller gear portion of the second gear 124*b* is engaged with a larger gear portion of the third gear 124*c*. A smaller gear portion of the third gear 124*c* is engaged with the fourth gear 124*d*. The fourth gear 124*d* is engaged with a larger gear portion of the fifth gear 124*c*. A smaller gear portion of the fifth gear 124*e* functions as a pinion, and is engaged with the rack 125. In other words, the first to third and fifth gear 124*a* to 124*c* and 124*e* function as reduction gears. The rack 125 is fixed to the downstream end of the medium tray 103 so that the toothed surface faces the smaller gear portion of the fifth gear 124*e* and extends along the height direction A1. The rack 125 is provided so as to move vertically along a guide portion such as a rail (not shown) formed along the height direction A1.

The transmission mechanisms 122 are respectively provided at both ends of the width direction A4. Thus, the medium conveying apparatus 100 can stably move the medium tray 103. The transmission mechanism 122 may be provided only at one end of the width direction A4. Thus, the medium conveying apparatus 100 can reduce a number of parts of the transmission mechanism 122 to reduce the apparatus cost and apparatus weight.

When the first motor 121 generates the first driving force, the belt 123 rotates in a direction of an arrow A21. Accordingly, the first to fifth gear 124*a* to 124*e* rotate in directions of arrows A21 to A25, respectively, so that the rack 125 is raised and the medium tray 103 is raised. On the other hand, when the first motor 121 generates the second driving force, the belt 123 rotates in an opposite direction of the arrow A21. Accordingly, the first to fifth gear 124*a* to 124*e* rotate in directions opposite to the arrows A21 to A25, and the rack 125 is lowered, the medium tray 103 is lowered. Thus, the transmission mechanism 122 transmits the driving force from the first motor 121 to the medium tray 103.

Further, a shielding member 126 is located on the downstream end of the medium tray 103, so as to protrude toward the downstream side. The shielding member 126 faces the medium tray sensor 112 when the medium tray 103 is located at an initial position, and is located at a position at which the shielding member 126 does not face the medium tray sensor 112 when the medium tray 103 is not located at the initial position. The medium tray sensor 112 includes a light emitter and a light receiver located to face each other across the shielding member 126. The light emitter is a LED, etc., and emits light toward the light receiver. On the other hand, the light receiver is a photodiode, etc., and receives the light emitted by the light emitter. The medium tray sensor 112 generates and outputs a first detection signal of which signal value changes between a state in which the shielding member 126 exists at a position of the medium tray sensor 112 and a state in which the shielding member 126 does not exist at the position, based on an intensity of light received by the light receiver. The medium tray sensor 112 is provided so that the signal value of the first detection signal changes between a state in which the medium tray 103 is located in the initial position and a state in which the medium tray 103 is not located in the initial position.

Figure 6:
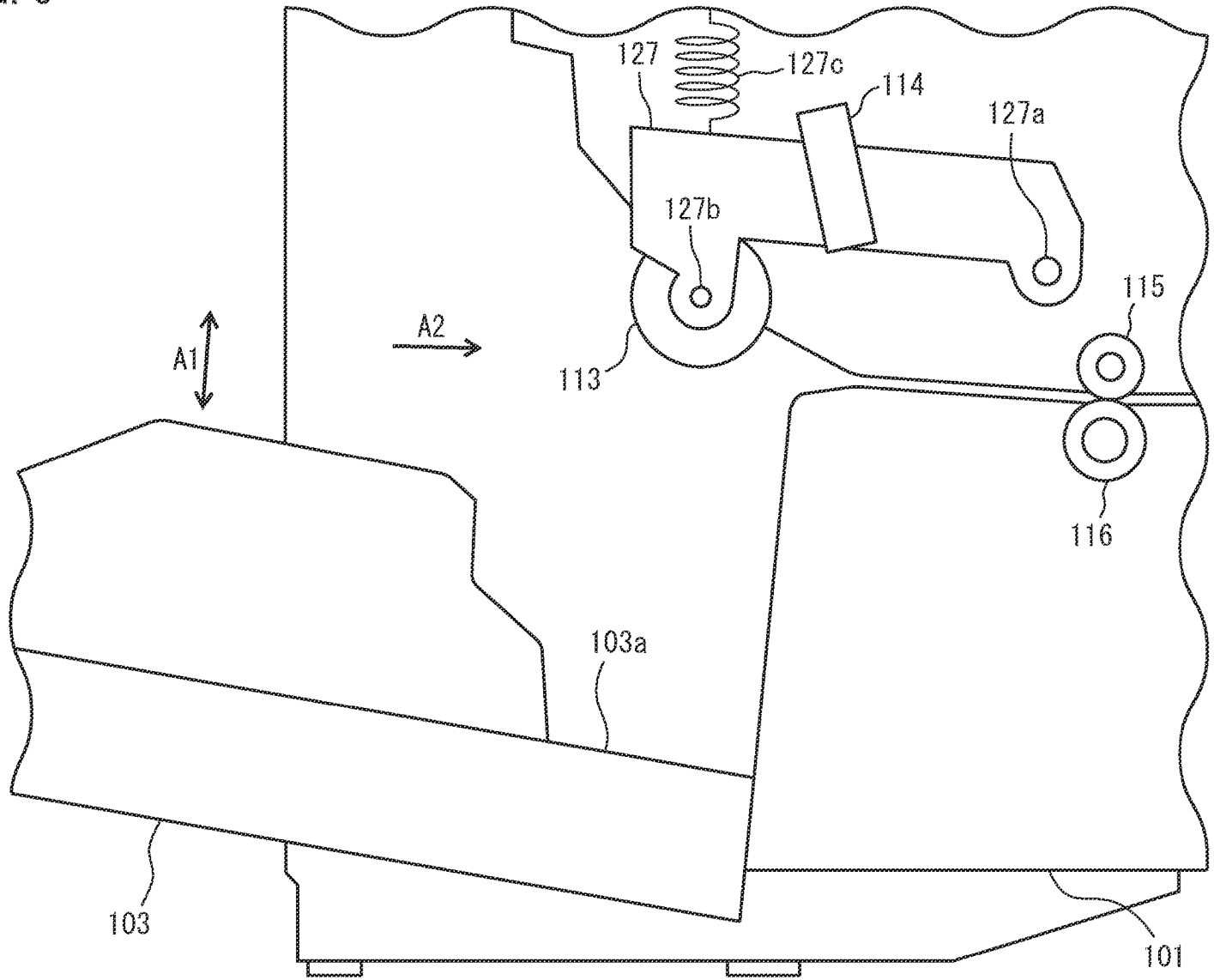
FIG. 6 is a schematic diagram for illustrating a pick roller 113, etc.

FIG. 6 is a schematic diagram for illustrating the pick roller 113 and the pick roller sensor 114.

As shown in FIG. 6, the medium conveying apparatus 100 further includes an arm 127. The arm 127 is provided in the second housing 102, to extend along the medium conveying direction A2, and so as to rotate (swing) about the downstream end 127*a*. The pick roller 113 is attached to the upstream end 127*b* of the arm 127. A biasing member 127*c* is attached above the arm 127. The biasing member 127*c* is a spring member, such as a torsion coil spring, or a rubber member, etc., to apply a biasing force downward to the arm 127. The biasing member 127*c* may be omitted, only the force by its own weight may be applied downward to the arm 127.

By the arm 127 biased downward, the pick roller 113 can appropriately convey the medium while pressing the medium placed on the medium tray 103 downward. Further, since the arm 127 is provided so as to move in the height direction A1, the pick roller 113 is located at the lowermost position when not abutting on the medium, and is pushed up by the medium placed on the medium tray 103 when abutting on the medium. Thus, even when the position (height) of the medium placed on the uppermost side of the media placed on the medium tray 103 is changed to some extent, the pick roller 113 can properly contact the medium placed on the uppermost side to convey the medium. Therefore, the medium conveying apparatus 100 does not need to move the medium tray 103 every time one medium is fed, and can shorten the processing time required for the medium reading process.

The pick roller sensor 114 includes a light emitter and a light receiver located to face each other across the arm 127. The light emitter is a LED, etc., and emits light toward the light receiver. On the other hand, the light receiver is a photodiode, etc., and receives the light emitted by the light emitter. The pick roller sensor 114 generates and outputs a second detection signal of which signal value changes between a state in which the arm 127 exists at the position of the pick roller sensor 114 and a state in which the arm does not exist based on an intensity of the light received by the light receiver. The pick roller sensor 114 is provided so that the signal value of the second detection signal changes between a state in which the pick roller 113 is located at the lowermost position and a state in which the pick roller 113 is pushed up by the medium placed on the medium tray 103.

Figure 7:
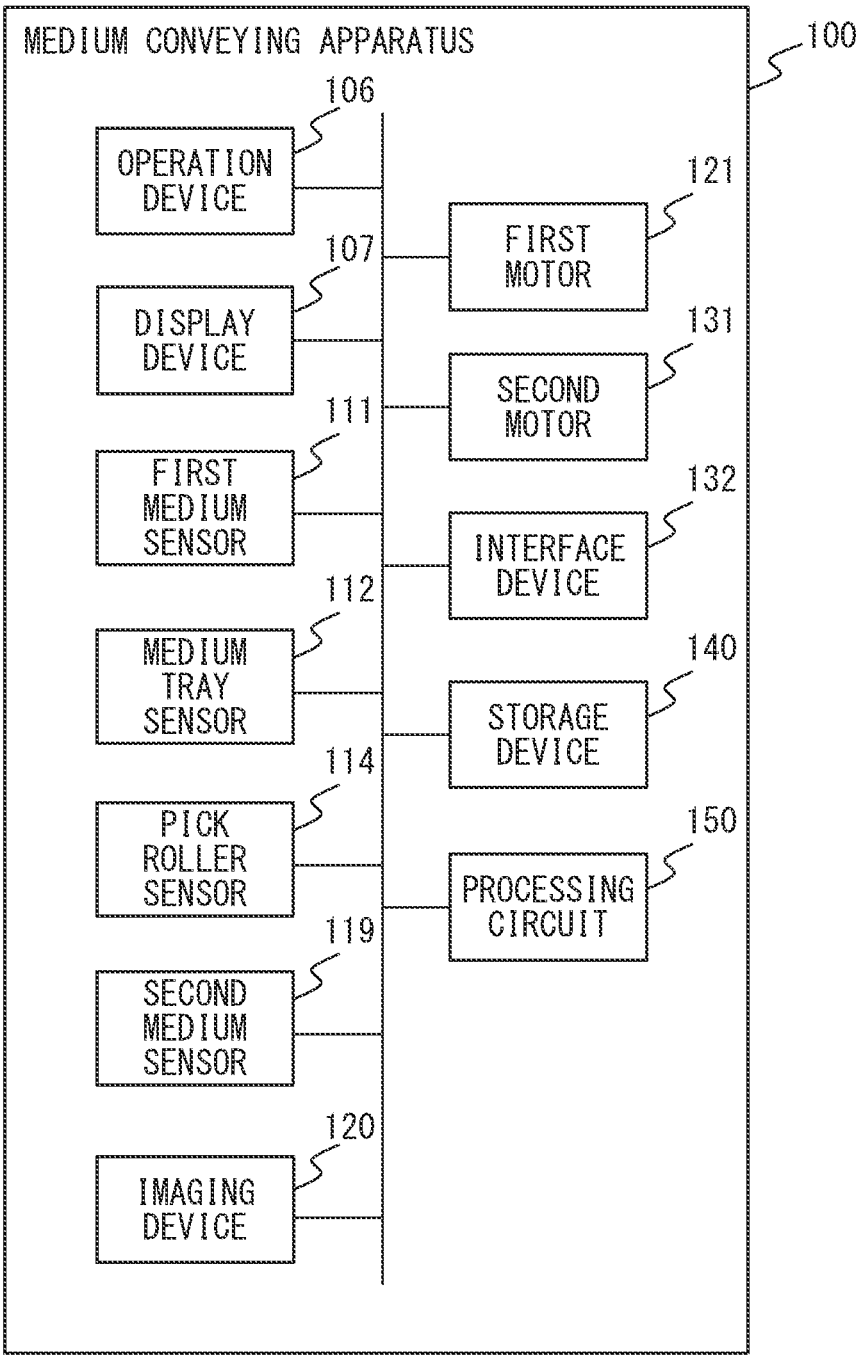
FIG. 7 is a block diagram illustrating a schematic configuration of the medium conveying apparatus 100.

FIG. 7 is a block diagram illustrating a schematic configuration of a medium conveying apparatus 100.

The medium conveying apparatus 100 further includes a second motor 131, an interface device 132, a storage device 140, a processing circuit 150, etc., in addition to the configuration described above.

The second motor 131 includes one or more motors. The second motor 131 rotates the pick roller 113, the feed roller 115, the separation roller 116 and the first to sixth conveying rollers 117*a* to 117*f*, to convey the medium by a control signal from the processing circuit 150. The first to sixth driven rollers 118*a* to 118*f* may be provided to rotate according to the driving force of the second motor 131, instead of being driven to rotate according to the first to sixth conveying rollers 117*a* to 117*f*.

For example, the interface device 132 includes an interface circuit conforming to a serial bus such as universal serial bus (USB), is electrically connected to an unillustrated information processing device (for example, a personal computer or a mobile information terminal), and transmits and receives an input image and various types of information. Further, a communication device including an antenna transmitting and receiving wireless signals, and a wireless communication interface circuit for transmitting and receiving signals through a wireless communication line in conformance with a predetermined communication protocol may be used in place of the interface device 132. For example, the predetermined communication protocol is a wireless local area network (LAN). The communication device may include a wired communication interface circuit for transmitting and receiving signals through a wired communication line in conformance with a communication protocol such as a wired LAN.

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 170 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 106, the display device 107, the first medium sensor 111, the medium tray sensor 112, pick roller sensor 114, the second medium sensor 119, the imaging device 120, the first motor 121, the second motor 131, the interface device 132 and the storage device 140, etc., to control these respective units. The processing circuit 150 performs the drive control of the first motor 121 and the second motor 131, and the imaging control of the imaging device 120, etc., based on the signal received from each sensor. The processing circuit 150 acquires the input image from the imaging device 120, and transmits it to the information processing apparatus via the interface device 132.

Figure 8:
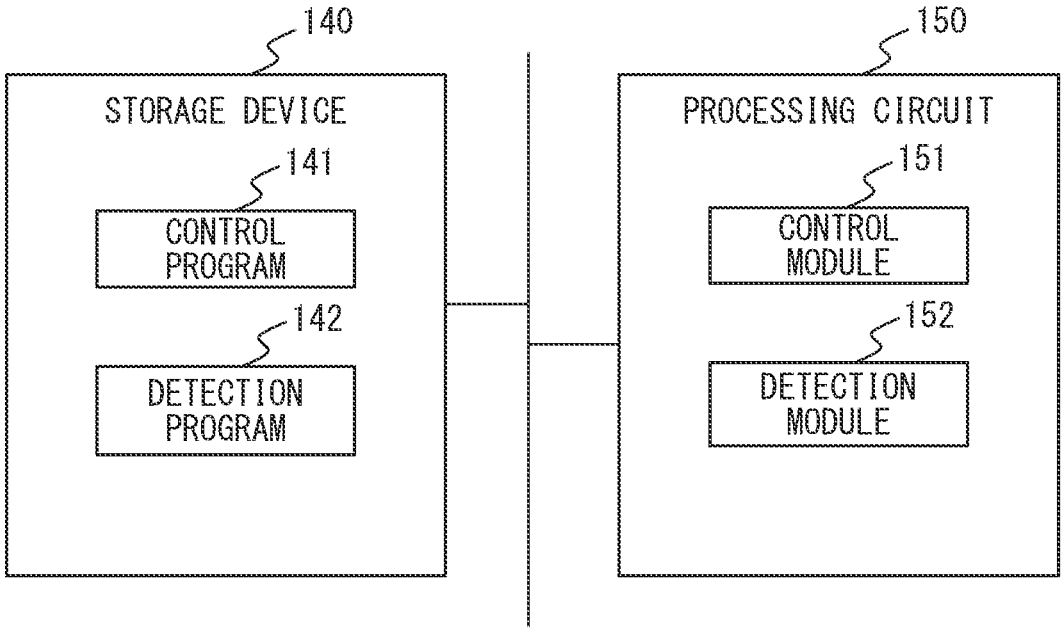
FIG. 8 is a diagram illustrating schematic configurations of a storage device 140 and a processing circuit 150.

FIG. 8 is a diagram illustrating schematic configurations of a storage device 140 and a processing circuit 150.

As shown in FIG. 8, the storage device 140 stores a control program 141 and a detection program 142, etc. Each of these programs is a functional module implemented by software operating on a processor. The processing circuit 150 reads each program stored in the storage device 140 and operates in accordance with each read program. Thus, the processing circuit 150 functions as a control module 151 and a detection module 152.

Figure 9:
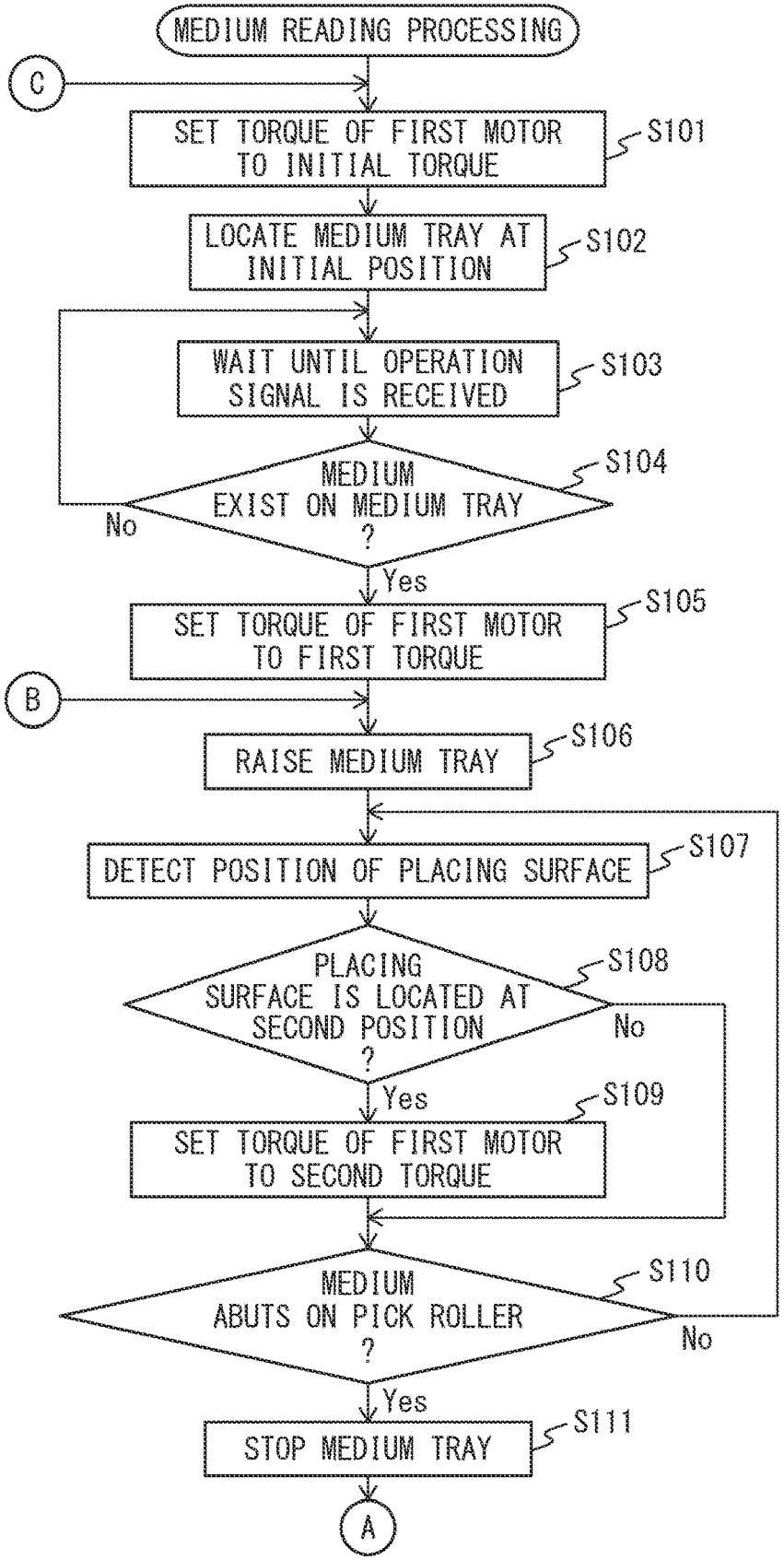
FIG. 9 is a flowchart illustrating an operation example of a medium reading processing.
Figure 10:
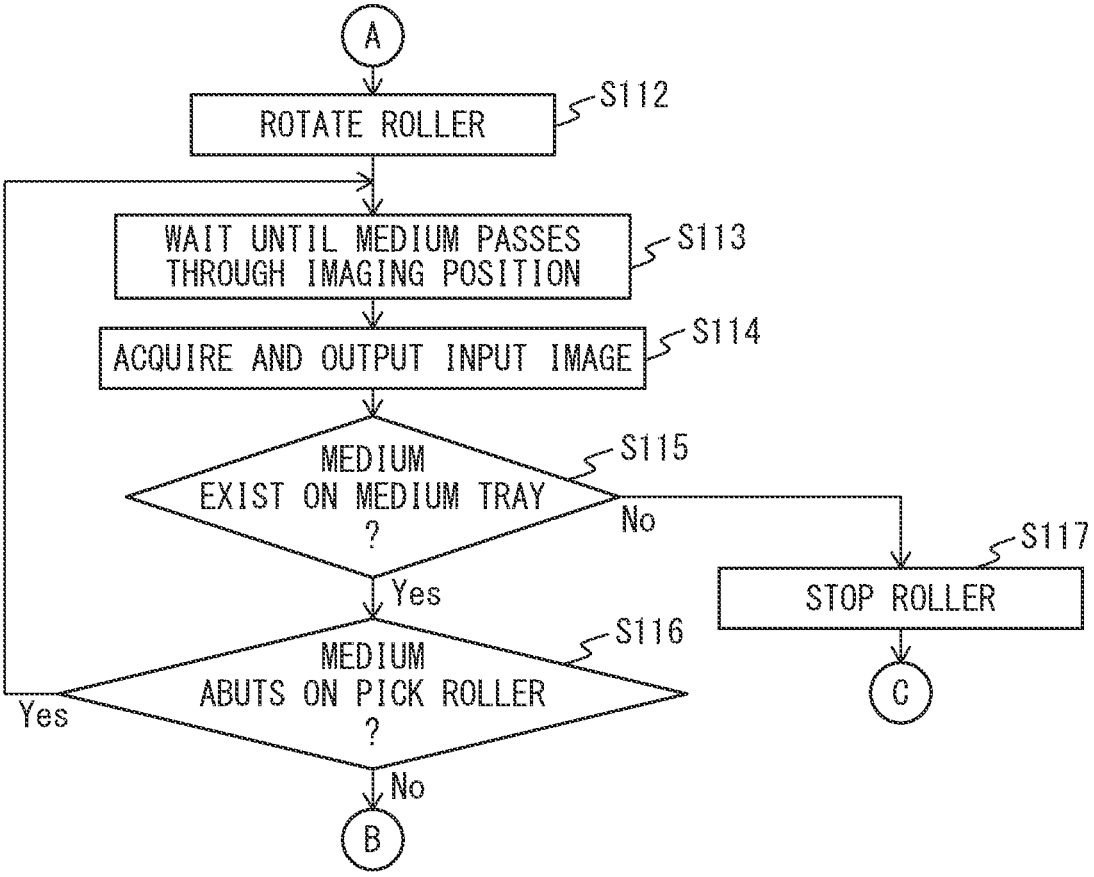
FIG. 10 is a flowchart illustrating an operation example of the medium reading processing.

FIGS. 9 and 10 are flowcharts illustrating an operation example of the medium reading process in the medium conveying apparatus 100.

Referring to the flowchart illustrated in FIGS. 9 and 10, the operation example of the medium reading process in the medium conveying apparatus 100 will be described below. The operation flow described below is executed mainly by the processing circuit 150 in cooperation with each element in the medium conveying apparatus 100, in accordance with a program previously stored in the storage device 140. The flowchart shown in FIGS. 9 and 10 is executed when the power supply of the medium conveying apparatus 100 is started.

First, the control module 151 sets the torque of the first motor 121 to an initial torque (step S101). The initial torque is set in advance to a sufficiently small magnitude by which the medium tray 103 can be lowered. The initial torque is set to a torque smaller than a first torque or a second torque to be described later. The control module 151 sets the torque of the first motor 121 to the initial torque, by setting the amount of the electric power (electric current) supplied to the first motor 121 to the amount of the electric power (electric current) corresponding to the initial torque.

Next, the control module 151 controls the first motor 121 to generate the second driving force, to locate the medium tray 103 at the initial position by lowering it (step S102). The control module 151 acquires the first detection signal periodically from the medium tray sensor 112, and determines that the medium tray 103 has been located at the initial position when the signal value of the first detection signal indicates that the medium tray 103 is located at the initial position.

Thus, the control module 151 locates the medium tray 103 at the initial position for a user to place the medium before start of conveyance of the medium. The control module 151 sets the torque of the first motor 121 to the initial torque when the control module 151 place the medium tray 103 at the initial position. The medium conveying apparatus 100 can move the medium tray 103 with a sufficiently small torque since it does not need to move the medium tray 103 against the gravitational force applied to the medium tray 103 when lowering the medium tray 103. The control module 151 can reduce the power consumption of the medium conveying apparatus 100, by reducing the amount of the electric power supplied to the first motor 121 when lowering the medium tray 103.

Next, the control module 151 waits until an instruction to read a medium is input by the user by use of the operation device 105 or the information processing device, and an operation signal instructing to read the medium is received from the operation device 105 or the interface device 132 (step S103).

Next, the control module 151 acquires the first medium signal from the first medium sensor 111, and determines whether or not the medium is placed on the medium tray 103 based on the acquired first medium signal (step S104). When a medium is not placed on the medium tray 103, the control module 151 returns the process to step S103, and waits until newly receiving an operation signal.

On the other hand, when the medium is placed on the medium tray 103, the control module 151 sets the torque of the first motor 121 to the first torque (step S105). The first torque is set in advance to a sufficiently large magnitude by which the medium tray 103 can be raised in a state in which media having the maximum weight supported by the medium conveying apparatus 100 are placed on the medium tray 103. The control module 151 sets the torque of the first motor 121 to the first torque, by setting the amount of the electric power (electric current) supplied to the first motor 121 to the amount of the electric power (electric current) corresponding to the first torque.

Next, the control module 151 controls the first motor 121 to generate the first driving force, to raise the medium tray 103 (step S106).

Next, the detection module 152 detects the position of the placing surface 103*a* of the medium tray 103 (step S107). The detection module 152 detects the position of the placing surface 103*a*, based on the driving amount by which the first motor 121 is driven after the medium tray 103 is located at the initial position by the control module 151. The medium conveying apparatus 100 stores in advance the position of the placing surface 103*a* when the medium tray 103 is located at the initial position, and the relationship between the driving amount for driving the first motor 121 and the moving amount of the medium tray 103, in the storage device 140. The detection module 152 acquires the driving amount by which the first motor 121 is driven after the medium tray 103 is located at the initial position from the control module 151, and detects the movement amount of the medium tray 103 from the acquired driving amount with reference to the relationship stored in the storage device 140. Then, the detection module 152 detects the present position of the placing surface 103*a* from the movement amount of the detected medium tray 103, with reference to the position of the placing surface 103*a* when the medium tray 103 is located at the initial position, which is stored in the storage device 140.

The medium conveying apparatus 100 may store in advance the relationship between the driving amount by which the first motor 121 is driven after the medium tray 103 is located at the initial position and the position of the placing surface 103*a*, in the storage device 140. In that case, the detection module 152 detects the present position of the placing surface 103*a* from the driving amount acquired from the control module 151 with reference to the relationship stored in the storage device 140.

As described above, the first motor 121 is the stepping motor. Therefore, the detection module 152 can correctly detect the position of the placing surface 103*a* from the step angle of the first motor 121, the reduction ratio by the first to fifth gears 124*a* to 124*c*, the size of the teeth of the pinion and the rack 125, and a number of input pulses to the first motor 121.

The medium conveying apparatus 100 can detect the present position of the placing surface 103*a* without using many sensors or expensive sensors, by detecting the position of the placing surface 103*a* based on the driving amount of the first motor 121 after the medium tray 103 is located at the initial position. Therefore, the medium conveying apparatus 100 can detect the present position of the placing surface 103*a* while suppressing an increase in the apparatus cost. A plurality of medium tray sensors 112 may be located at positions facing the shielding member 126 along the moving direction of the medium tray 103, and the medium conveying apparatus 100 may detect the present position of the placing surface 103*a*, based on the first detection signals acquired from the medium tray sensors 112. Further, an encoder for detecting the movement amount of the medium tray 103 may be located, and the medium conveying apparatus 100 may detect the present position of the placing surface 103*a* based on the detection result of the movement amount of the medium tray 103 by the encoder.

Next, the control module 151 determines whether or not the position of the placing surface 103*a* is the second position which is within a predetermined range or the first position which is outside the predetermined range (step S108). For example, the predetermined range is set to a range in which a gap between the first housing 101 or the second housing 102 where the medium tray 103 is provided and the medium tray 103 is equal to or less than a predetermined width. For example, the predetermined width is set to the maximum value (e.g., 25 mm) of the thickness of the object that can be worn by the user of the medium conveying apparatus 100. The object that can be worn by the user of the medium conveying apparatus 100 is a case for a card, such as an employee ID card, a communication device, such as a mobile phone, or a writing instrument, such as a pen, etc., which is hung from a neck by using a strap, etc. The gap between the first housing 101 or the second housing 102 and the medium tray 103 is smaller (narrower) as the medium tray 103 rises. Therefore, the second position is set to a position above the first position. When the position of the placing surface 103*a* is the first position, the control module 151 proceeds the process to step S110, without performing a particular process.

On the other hand, when the position of the placing surface 103*a* is the second position, the control module 151 sets the torque of the first motor 121 to the second torque smaller than the first torque (step S109). The second torque is set in advance to a magnitude by which the medium tray 103 on which the media having the maximum weight that can be placed on the medium tray 103 of which the placing surface 103*a* is located at the second position (within the predetermined range) are placed, can be raised. Further, the second torque is set to a sufficiently small magnitude by which the medium tray 103 cannot be moved when the object is caught in the gap between the first housing 101 or the second housing 102 and the medium tray 103.

For example, the second torque is set to a magnitude of ½ or less of the first torque. Further, for example, the first torque and the second torque are set so that a lifting force of the medium tray 103 of which the placing surface 103*a* is located at the second position is ⅓ or less of a lifting force of the medium tray 103 of which the placing surface 103*a* is located at the first position. Further, for example, the first torque and the second torque are set so that a load applied to the medium tray 103 of which the placing surface 103*a* is located at the second position is ⅓ or less of a load applied to the medium tray 103 of which the placing surface 103*a* is located at the first position. Further, for example, the first torque and the second torque are set so that a pinching force applied to the medium by the second torque is ¼ or less of a pinching force applied to the medium by the first torque when only one medium is placed on the medium tray 103.

The control module 151 sets the torque of the first motor 121 to the second torque, by setting the amount of the electric power (electric current) supplied to the first motor 121 to the amount of the electric power (electric current) corresponding to the second torque. When the torque of the first motor 121 has already been set to the second torque, the process of step S109 is omitted.

Figure 11:
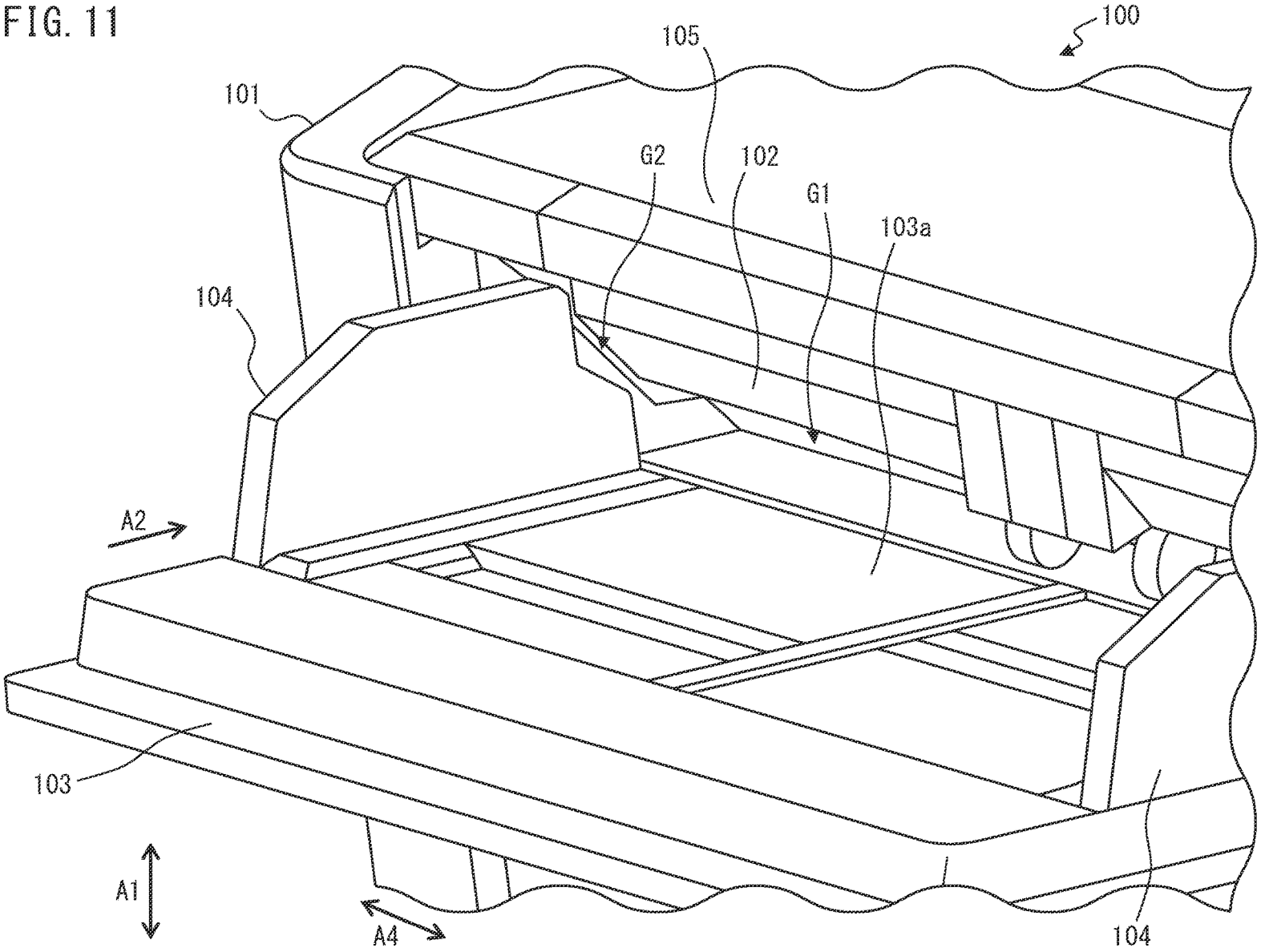
FIG. 11 is a schematic diagram for illustrating a gap.
Figure 12:
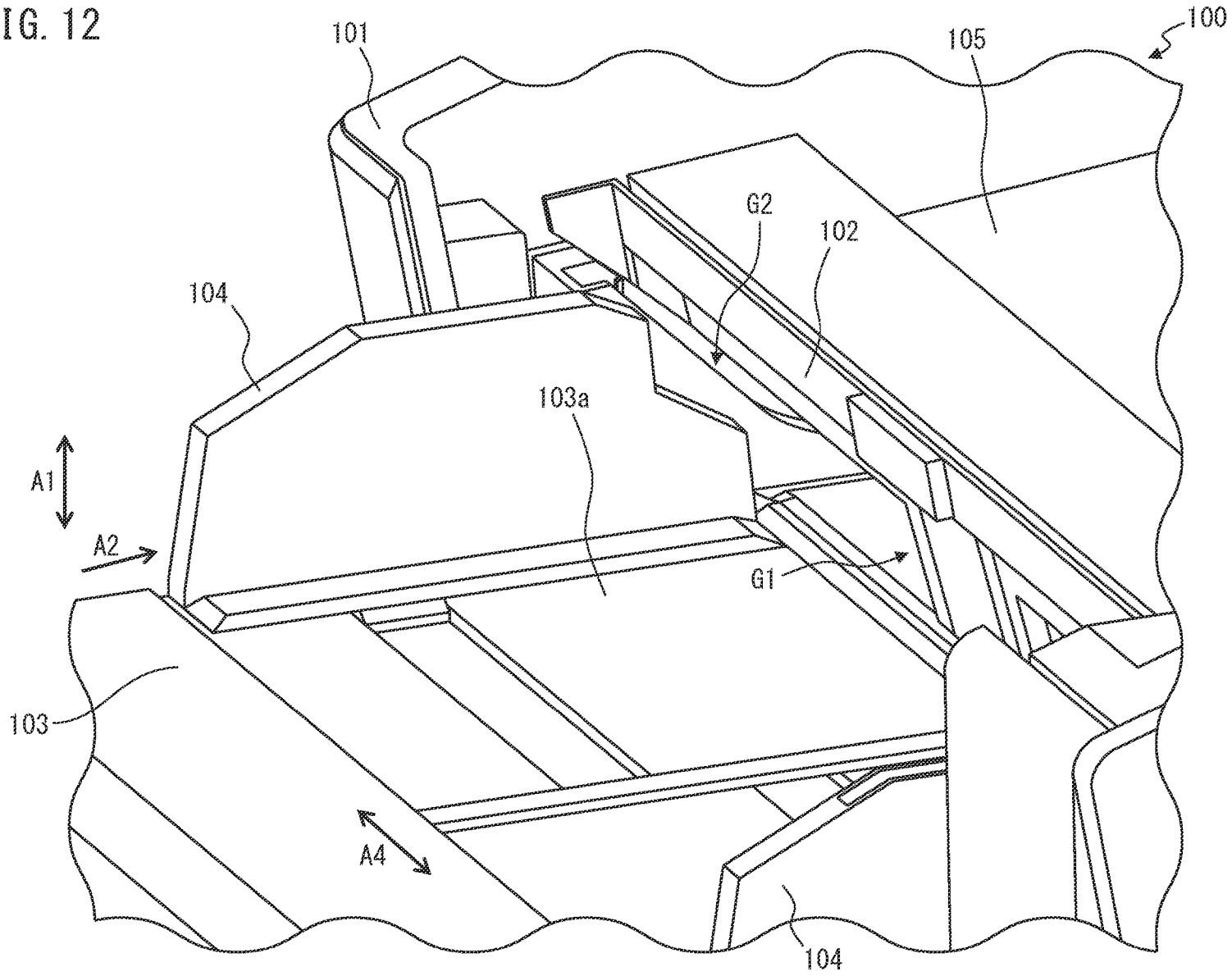
FIG. 12 is a schematic diagram for illustrating a gap.

FIGS. 11 and 12 are schematic diagrams for illustrating the gap between the first housing 101 or the second housing 102 and the medium tray 103. FIG. 11 is an enlarged view in which the medium tray 103 located in the conveying position shown in FIG. 2 is enlarged. FIG. 12 is an enlarged view in which the medium tray 103 shown in FIG. 11 is further enlarged and is viewed from slightly above.

As shown in FIGS. 11 and 12, there is a gap G1 between the first housing 101 or the second housing 102 and the medium tray 103, around an insertion port of the medium (upstream side portion). Further, there is a gap G2 between members for engaging the first housing 101 or the second housing 102 with the medium tray 103, around both ends of the width direction A4. When the medium tray 103 is located at the initial position as shown in FIG. 1, the gap G1 and the gap G2 are sufficiently large. On the other hand, when the medium tray 103 is located at the conveying position, as shown in FIGS. 2, 11 and 12, the gap G1 and the gap G2 are small (narrow).

When the object, such as the card case, the communication device or the writing instrument, is hanging from the neck of the user of the media conveying apparatus 100, the object may be placed around the medium tray 103 during operation. When the medium tray 103 is raised in that state, the object may enter the gap G1 or the gap G2, be caught between the first housing 101 or the second housing 102 and the medium tray 103, and be damaged.

The control module 151 sets the torque of the first motor 121 to the first torque when the medium tray 103 is located at the initial position, and then does not change the torque of the first motor 121 from the first torque as long as the position (height) of the placing surface 103*a* is the first position. In other words, the control module 151 sets the torque of the first motor 121 to a sufficiently large first torque when the position of the placing surface 103*a* is the first position. Thus, the control module 151 can satisfactorily move the medium tray 103 with a sufficiently large force. On the other hand, the control module 151 sets the torque of the first motor 121 to a sufficiently small second torque when the position of the placing surface 103*a* is the second position above the first position. Thus, when the object is caught between the first housing 101 or the second housing 102 and the medium tray 103, the medium tray 103 does not move any further, and thereby, occurrence of damage to the object is suppressed.

Further, the total thickness of the medium placed on the medium tray 103 is equal to or less than a distance between the lower surface of the pick roller 113 and the present position of the placing surface 103*a*. When the position of the placing surface 103*a* is the second position, the total weight of the medium placed on the medium tray 103 is estimated to be sufficiently small. Therefore, when the position of the placing surface 103*a* is the second position, the medium conveying apparatus 100 can move the medium tray 103 sufficiently, even when reducing the torque of the first motor 121.

As described above, the second position is set within the predetermined range in which the gap between the first housing 101 or the second housing 102 on which the medium tray 103 is provided and the medium tray 103 is equal to or less than 25 mm. On the other hand, the first position is set outside the predetermined range. Thus, the medium conveying apparatus 100 can suppress the occurrence of damage to the object whose thickness is equal to or less than 25 mm, such as the card case, the communication device, or the writing instrument when the object enters the gap between the first housing 101 or the second housing 102 and the medium tray 103.

Next, the control module 151 determines whether or not the medium placed on the medium tray 103 abuts on the pick roller 113 (step S110). The control module 151 acquires the second detection signal periodically from the pick roller sensor 114. The control module 151 determines that the medium placed on the medium tray 103 abuts on the pick roller 113 when the signal value of the second detection signal indicates that the pick roller 113 is pushed up by the medium placed on the medium tray 103. When the medium placed on the medium tray 103 has not abutted on the pick roller 113, the control module 151 returns the process to step S107, and repeats the processes in steps S107 to S110.

On the other hand, when the medium placed on the medium tray 103 has abutted on the pick roller 113, the control module 151 controls the first motor 121 to stop the medium tray 103 (step S111). Thus, the control module 151 controls the first motor 121 so that the medium tray 103 is located at the position at which the medium placed on the uppermost side of the media placed on the medium tray 103 abuts on the pick roller 113.

Next, the control module 151 controls the second motor 131 to rotate the pick roller 113, the feed roller 115, the separation roller 116, the first to sixth conveying roller 117*a* to 117*f*, and/or the first to sixth driven roller 118*a* to 118*f* to convey the medium (step S112).

Next, the control module 151 waits until the rear end of the medium passes through an imaging position of the imaging device 120 (step S113). The control module 151 acquires the second medium signal periodically from the second medium sensor 119. The control module 151 determines that the rear end of the medium has passed through the position of the second medium sensor 119 when the signal value of the second medium signal changes from a value indicating that a medium exists to a value indicating that there is no medium. The control module 151 determines that the rear end of the medium has passed through the imaging position when a predetermined time has elapsed after the rear end of the medium passes through the position of the second medium sensor 119. The predetermined time is set to a value acquired by adding a margin to the time required for the medium to move from the position of the second medium sensor 119 to the imaging position.

Next, the control module 151 acquires the input image from the imaging device 120, and outputs by transmitting the acquired input image to the information processing apparatus via the interface device 132 (step S114).

Next, the control module 151 determines whether or not the medium remains on the medium tray 103 based on the first medium signal received from the first medium sensor 111 (step S115).

When the medium remains on the medium tray 103, the control module 151, in the same manner as in the process in step S111, determines whether or not the medium placed on the medium tray 103 abuts on the pick roller 113 (step S116).

When the medium placed on the medium tray 103 abuts on the pick roller 113, the control module 151 returns the process to step S113, and acquires and outputs the input image in which the next medium is imaged.

On the other hand, when the medium placed on the medium tray 103 does not abut on the pick roller 113, the control module 151 returns the process to step S106, and raises the medium tray 103 until the medium placed on the medium tray 103 abuts on the pick roller 113. At this time, the first motor 121 raises the medium tray 103 by a torque that is currently set, and raises the medium tray 103 by the second torque after it is determined that the position of the placing surface 103*a* is the second position in step S108.

As described above, the pick roller 113 is pressed downward by the biasing member 127*c*, and continues to abut on the medium placed on the uppermost of the media remaining on the medium tray 103 while a particular number of media is conveyed, even when the medium tray 103 does not move. The control module 151 controls the first motor 121 so that the medium tray 103 is located at the position at which the medium placed on the uppermost side of the media placed on the medium tray 103 abuts on the pick roller 113 each time a particular number of media of the media placed on the medium tray 103 is conveyed. Thus, the medium conveying apparatus 100 can reduce the frequency of moving the medium tray 103 by the first motor 121 to shorten the processing time required for the medium reading process.

On the other hand, when the medium does not remain on the medium tray 103, in step S115, the control module 151 controls the second motor 131 to stop the respective rollers (step S117), and returns the process to step S101. In this case, the control module 151 sets the torque of the first motor 121 to the initial torque in step S101, lowers the medium tray 103 to locate it at the initial position in step S102, and waits until receiving a new operation signal in step S103. Thus, the description of the medium reading process is completed.

In the medium conveying apparatus 100, the pick roller sensor 114 may be omitted. In that case, in steps S106 to S110, the control module 151 drives the first motor 121 by a predetermined driving amount. The predetermined driving amount when moving the medium tray 103 from the initial position is set to a driving amount for moving the table 103 by a distance between the placing surface 103*a* of the table 103 located at the initial position and the lower surface of the pick roller 113 located at a predetermined position within its movable range. In that case, when a large amount of media are placed on the medium tray 103, the power consumption is increased since the first motor 121 continues to drive even after the pick roller 113 is located at the uppermost position in the movable range. However, also in this case, the control module 151 can move the medium tray 103 at the position at which the medium tray 103 abuts on the medium.

Further, in step S117, the control module 151 determines whether or not a predetermined number of media has been conveyed after the pick roller 113 is located at a predetermined position. The predetermined number is set to a value equal to or less than a division value acquired by dividing the distance between the predetermined position and the lowermost position within the movable range of the pick roller 113 by the maximum thickness of the medium supported by the medium conveying apparatus 100. The predetermined number may be set to 1. When a predetermined number of media has not yet been conveyed after the pick roller 113 is located at the predetermined position, the control module 151 returns the process to step S113, not to move the medium tray 103. On the other hand, when a predetermined number of media has been conveyed after the pick roller 113 is located at the predetermined position, the control module 151 returns the process to step S106, to raise the medium tray 103. In this case, the predetermined driving amount is set to a driving amount for moving the medium tray 103 by a distance between the predetermined position and the lowermost position within the movable range of the pick roller 113.

In this case, the control module 151 also controls the first motor 121 so that the medium tray 103 is located at the position at which the medium placed on the uppermost side of the media placed on the medium tray 103 abuts on the pick roller 113 each time a particular number of media is conveyed.

Further, the control module 151 may change the torque of the first motor 121 to multi-stage which is three or more stages, depending on the position of the placing surface 103*a*. In that case, the control module 151 sets the torque of the first motor 121 to a smaller value, as the position of the placing surface 103*a* is higher, i.e., as the gap between the first housing 101 or the second housing 102 and the medium tray 103 is smaller. Thus, the control module 151 can more flexibly control the torque of the first motor 121, to move the medium tray 103 with more appropriate force, while suppressing the occurrence of damage to the object worn by the user.

Further, the medium conveying apparatus 100 may further include a sensor to detect step-out of the first motor 121 (stepping motor), and the control module 151 may stop the medium reading process when step-out of the first motor 121 occurs. Thus, the medium conveying apparatus 100 can appropriately stop the medium reading process when the medium tray 103 is lowered by the operation of the user and the step-out of the first motor 121 occurs.

As described in detail above, the medium conveying apparatus 100 reduces the torque of the first motor 121 when the position of the medium tray 103 provided so as to be raised by the first motor 121 is above a specific height. Thus, the medium conveying apparatus 100 can suppress the occurrence of damage to the object worn by the user when the medium tray 103 is raised.

The medium conveying apparatus 100 moves the medium tray 103 at a sufficiently large torque when the medium tray 103 is located at the first position. Thus, the medium conveying apparatus 100 can satisfactorily move the medium tray 103 with a sufficiently large torque when a large amount of media are placed on the medium tray 103. Therefore, the medium conveying apparatus 100 can continuously convey a large amount of media collectively placed on the medium tray 103, to improve the convenience of the user.

Further, the medium conveying apparatus 100 moves the medium tray 103 with a sufficiently small torque when the medium tray 103 is located at the second position. Thus, the medium conveying apparatus 100 can suppress the occurrence of damage to the object worn by the user, when the object is caught between the first housing 101 or the second housing 102 (a frame or a cover included in the housing) and the medium tray 103. Therefore, the medium conveying apparatus 100 can suppress the occurrence of damage to the object, even when the gap between the first housing 101 or the second housing 102 and the medium tray 103 is reduced, by reducing the apparatus size, or by increasing the movable range of the medium tray 103. As a result, the medium conveying apparatus 100 can reduce the apparatus size, or increase the movable range of the medium tray 103.

Further, the medium conveying apparatus 100 can reduce the power consumption for the movement of the medium tray 103, and can reduce the noise occurring during the movement of the medium tray 103, by moving the medium tray 103 with a small torque when the medium tray 103 is located at the second position.

Figure 13:
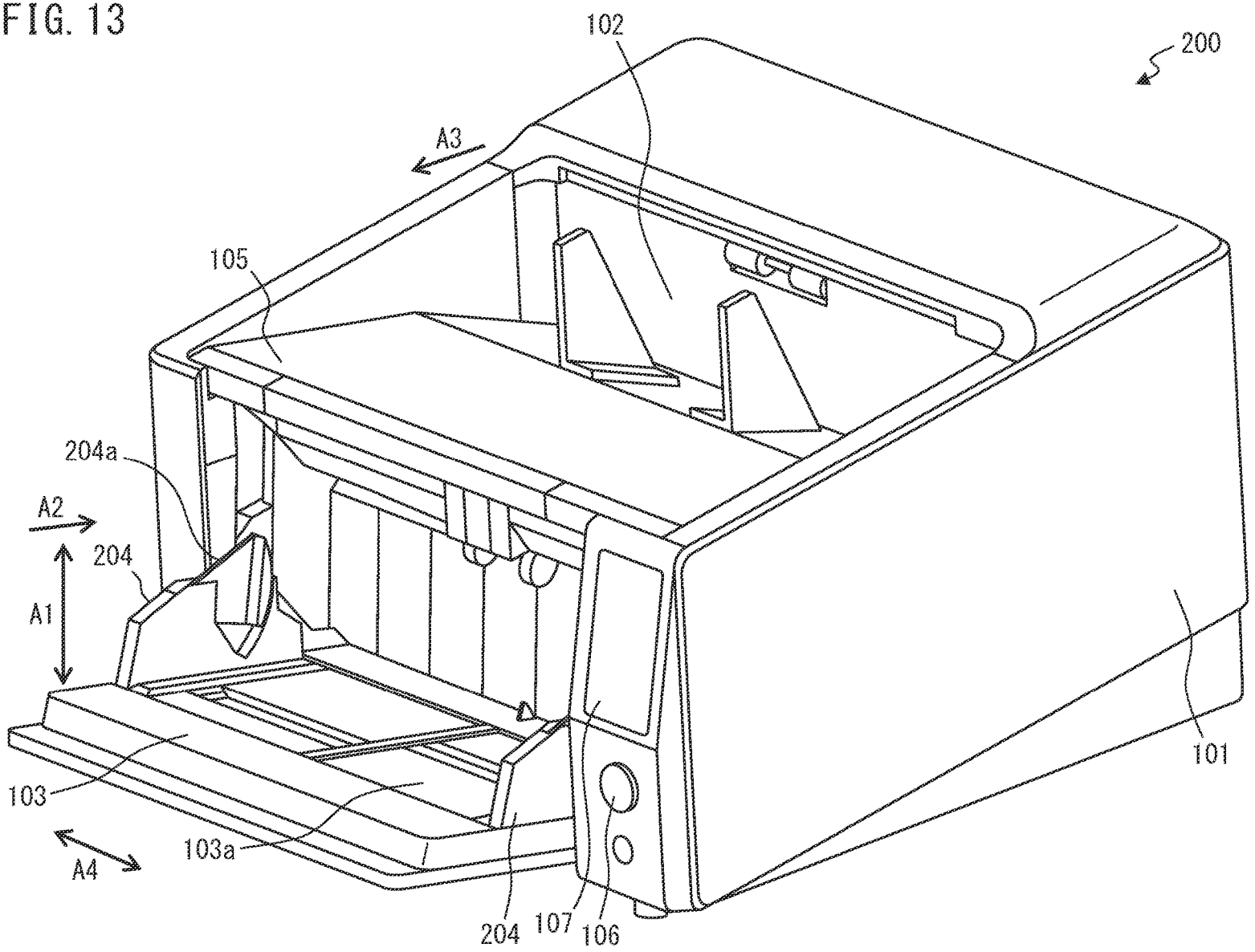
FIG. 13 is a schematic diagram for illustrating another side guide 204.
Figure 14:
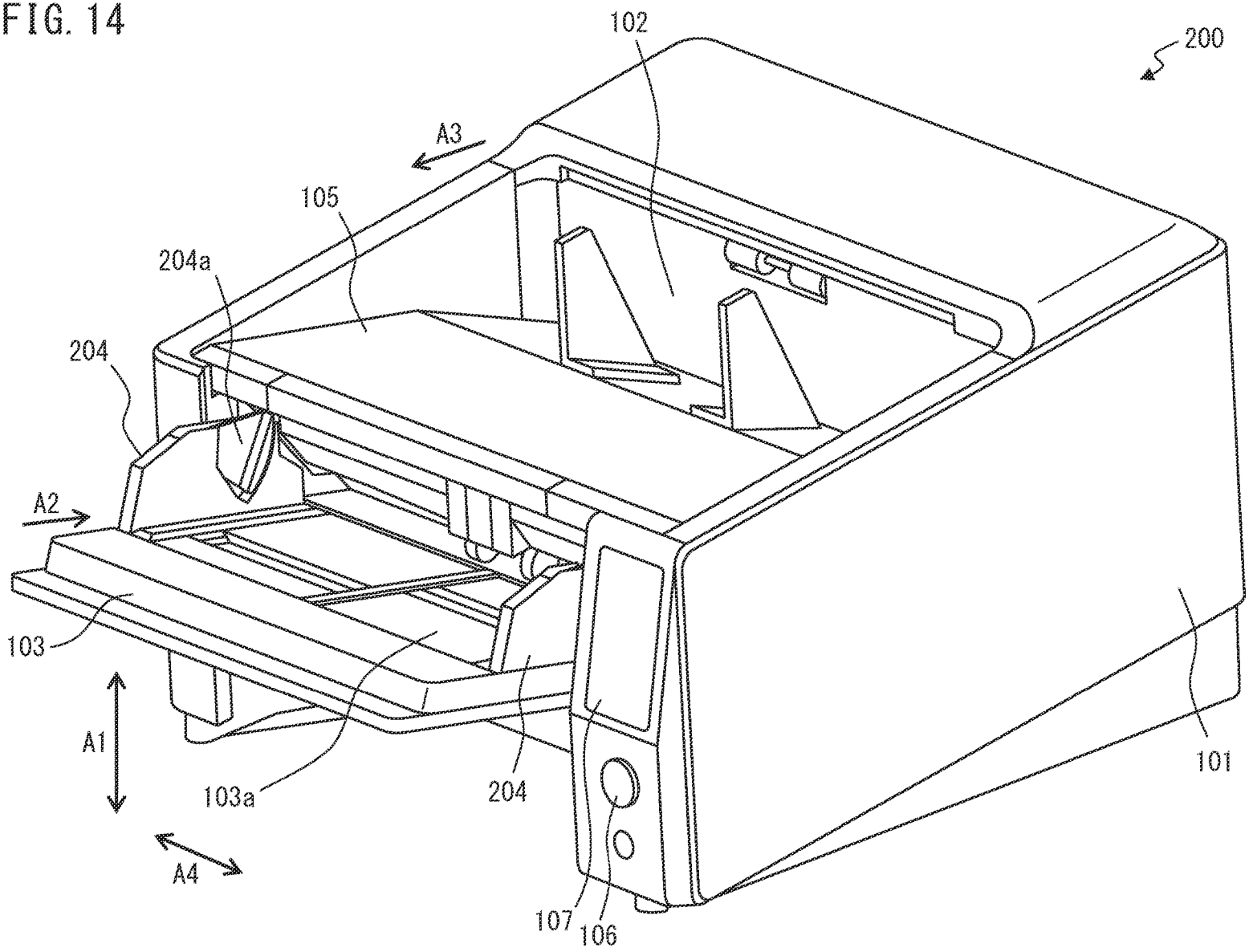
FIG. 14 is a schematic diagram for illustrating another side guide 204.

FIGS. 13 and 14 are schematic diagrams for illustrating a side guide 204 of the medium conveying apparatus 200 according to another embodiment. FIG. 13 is a perspective view illustrating the medium conveying apparatus 200 in a state where the medium tray 103 is located at the initial position. FIG. 14 is a perspective view illustrating the medium conveying apparatus 200 in a state where the medium tray 103 is located at the conveying position.

The medium conveying apparatus 200 includes the respective portions of the medium conveying apparatus 100. The medium conveying apparatus 200 includes a side guide 204, instead of the side guide 104. The side guide 204 has a structure and a function similar to the side guide 104. A swing member 204*a* is provided on the side guide 204. The swing member 204*a* is provided on the upper end portion of the side guide 204 so as to swing in the vertical direction. The biasing force toward the upper by a biasing member (not shown) is applied to the swing member 204*a*. The biasing member is a spring member, such as a torsion coil spring, or a rubber member, etc.

As shown in FIG. 13, when the medium tray 103 is located at the initial position, and the swing member 204*a* does not abut on the first housing 101 or the second housing 102, the swing member 204*a* is located to protrude upward from the side guide 204 by the biasing force by the biasing member. On the other hand, as shown in FIG. 14, when the medium tray 103 is raised, and the swing member 204*a* abuts on the first housing 101 or the second housing 102, the swing member 204*a* is pressed by the first housing 101 or the second housing 102, to be accommodated in the side guide 204. Thus, when the medium tray 103 is located at a low position, and a large amount of media are placed on the medium tray 103, the medium conveying apparatus 200 can increase the height of the side guide 204, to satisfactorily regulate the width direction of the large amount of the media placed on the medium tray 103. On the other hand, the medium conveying apparatus 200 can suppress that the object worn by the user is damaged by being caught between the housing and the side guide 204, while satisfactorily regulating the width direction of the medium, when the medium tray 103 is located at a high position, and a small amount of media are placed on the medium tray 103.

As described in detail above, the medium conveying apparatus 200 can suppress the occurrence of damage to the object worn by the user when the medium tray 103 is raised, even when the side guide 204 is movably provided.

Figure 15:
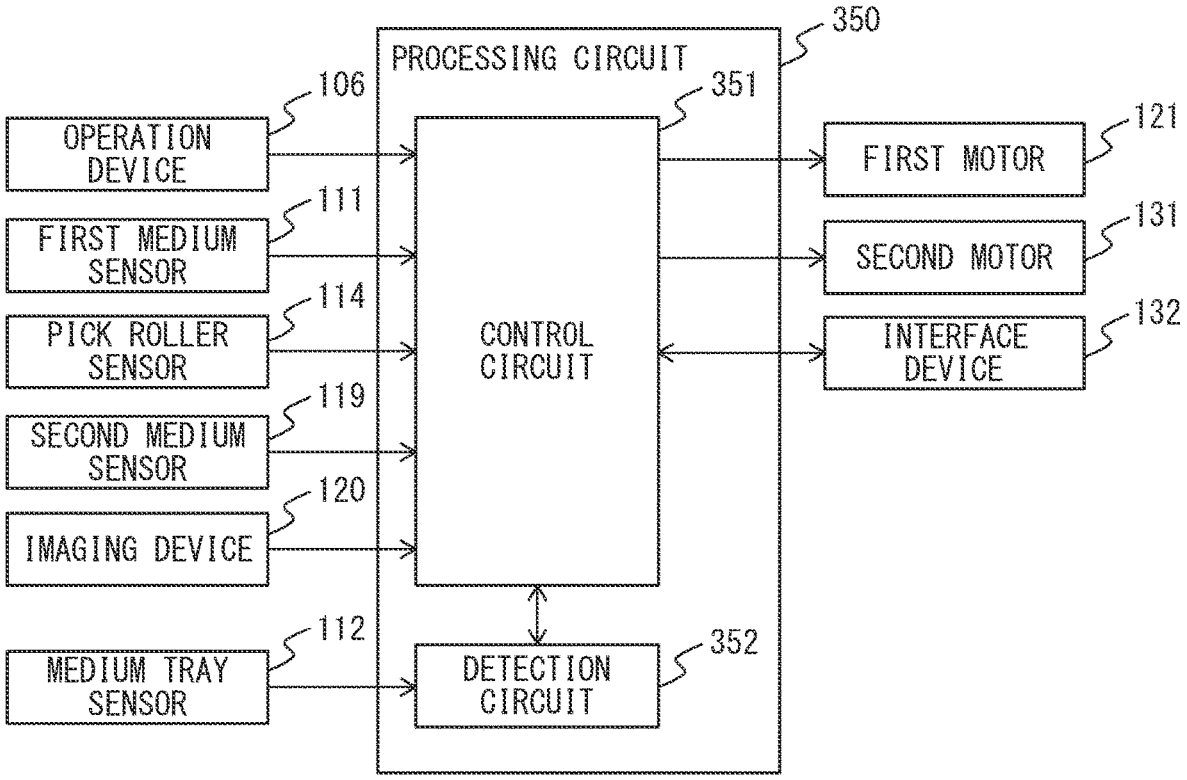
FIG. 15 is a diagram illustrating a schematic configuration of a processing circuit 350 according to another embodiment.

FIG. 15 is a diagram illustrating a schematic configuration of a processing circuit 350 of a medium conveying apparatus according to another embodiment.

The processing circuit 350 is used in place of the processing circuit 150 of the medium conveying apparatus 100 and executes the medium read process, etc., instead of the processing circuit 150. The processing circuit 350 includes a control circuit 351 and a detection circuit 352, etc. Note that each unit may be configured by an independent integrated circuit, a microprocessor, firmware, etc.

The control circuit 351 is an example of a control module, and has a function similar to the control module 151. The control circuit 351 receives the operation signal from the operating device 106 or the interface device 132, the first medium signal from the first medium sensor 111, the second detection signal from the pick roller sensor 114, and the second medium signal from the second medium sensor 119. Further, the control circuit 351 outputs the driving amount by which the first motor 121 is driven to the detection circuit 352, and receives the detection result of the position of the placing surface 103*a* from the detection circuit 352. The control circuit 351 controls the first motor 121 and the second motor 131 based on the received information, acquires the input image from the imaging device 120, and outputs it to the interface device 132.

The detection circuit 352 is an example of a detection module, and has a functions similar to the detection module 152. The detection circuit 352 receives the second detection signal from the medium tray sensor 112, the driving amount of the first motor 121 from the control circuit 351. The detection circuit 352 detects the position of the placing surface 103*a* based on the received information, and outputs the detection result to the control circuit 351.

As described in detail above, the medium conveying apparatus can suppress the occurrence of damage to the object worn by the user when the medium tray 103 is raised, even when using the processing circuit 350.

When the object, such as the card case, the communication device or the writing instrument, is hanging from the neck of the user of the media conveying apparatus, the object may be placed on the medium tray of the medium conveying apparatus. In that case, when the medium conveying apparatus raises the medium tray, the object may enter the gap between the housing and the medium tray of the apparatus, and may be damaged by being caught between the housing and the medium tray.

The medium conveying apparatus, the medium conveying method, and the computer-readable, non-transitory medium storing the computer program according to the embodiment can suppress the occurrence of damage to the object worn by the user when the medium tray is raised.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a motor in which a setting of a torque can be changed according to a supplied power;

a medium tray provided on a housing and to be raised, and including a placing surface;

a roller to abut on a medium placed on the medium tray to convey the medium; and a processor to control the motor so that the medium tray is located at a position at which the medium placed on the medium tray abuts on the roller, each time a particular number of media placed on the medium tray is conveyed, and detect a position of the placing surface, wherein the processor sets the torque of the motor to a first torque when the placing surface is in a first position, and sets the torque of the motor to a second torque smaller than the first torque when the placing surface is in a second position above the first position, and wherein a gap between the housing where the medium tray is provided and the medium tray is exposed to an outside of the medium conveying apparatus, during conveying the medium.

2. The medium conveying apparatus according to claim 1, wherein the processor locates the medium tray at an initial position for a user to place the medium before start of conveyance of the medium, and wherein the processor detects the position of the placing surface, based on a driving amount by which the motor is driven after the medium tray is located at the initial position by the processor.

3. The medium conveying apparatus according to claim 1, wherein the second position is set within a range in which a gap between a housing where the medium tray is provided and the medium tray is equal to or less than 25 mm, and wherein the first position is set outside the range in which the gap between the housing and the medium tray is equal to or less than 25 mm.

4. The medium conveying apparatus according to claim 1, wherein the motor is a stepping motor.

5. The medium conveying apparatus according to claim 1, wherein the processor locates the medium tray at an initial position for a user to place the medium before start of conveyance of the medium, and wherein the processor sets the torque of the motor to a torque smaller than the first torque when the processor locates the medium tray at the initial position.

6. A medium conveying method performed by a medium conveying apparatus comprising:

conveying a medium by a roller placed on a placing surface of a medium tray;

controlling a motor in which a setting of a torque can be changed so that the medium tray is located at a position at which the medium placed on the medium tray abuts on the roller each time a particular number of media placed on the medium tray is conveyed;

detecting a position of the placing surface; and setting the torque of the motor to a first torque when the placing surface is in a first position, and setting the torque of the motor to a second torque smaller than the first torque when the placing surface is in a second position above the first position, wherein a gap between a housing where the medium tray is provided and the medium tray is exposed to an outside of the medium conveying apparatus during conveying the medium.

7. The medium conveying method according to claim 6, wherein the medium tray is located at an initial position for a user to place the medium before start of conveyance of the medium, and wherein the position of the placing surface is detected based on a driving amount by which the motor is driven after the medium tray is located at the initial position.

8. The medium conveying method according to claim 6, wherein the second position is set within a range in which a gap between a housing where the medium tray is provided and the medium tray is equal to or less than 25 mm, and wherein the first position is set outside the range in which the gap between the housing and the medium tray is equal to or less than 25 mm.

9. The medium conveying method according to claim 6, wherein the motor is a stepping motor.

10. The medium conveying method according to claim 6, wherein the medium tray is located at an initial position for a user to place the medium before start of conveyance of the medium, and wherein the torque of the motor is set to a torque smaller than the first torque when the medium tray is located at the initial position.

11. A computer-readable, non-transitory medium storing a computer program, wherein the computer program causes a medium conveying apparatus including a motor in which a setting of a torque can be changed, a medium tray provided so as to be raised and including a placing surface, a roller to convey a medium to execute a process, the process comprising:

conveying the medium by the roller placed on the medium tray;

controlling a motor in which a setting of a torque can be changed so that the medium tray is located at a position at which the medium placed on the medium tray abuts on the roller each time a particular number of media placed on the medium tray is conveyed;

detecting a position of the placing surface; and setting the torque of the motor to a first torque when the placing surface is in a first position, and setting the torque of the motor to a second torque smaller than the first torque when the placing surface is in a second position above the first position, wherein a gap between a housing where the medium tray is provided and the medium tray is exposed to an outside of the medium conveying apparatus during conveying the medium.

12. The computer-readable, non-transitory medium according to claim 11, wherein the medium tray is located at an initial position for a user to place the medium before start of conveyance of the medium, and wherein the position of the placing surface is detected based on a driving amount by which the motor is driven after the medium tray is located at the initial position.

13. The computer-readable, non-transitory medium according to claim 11, wherein the second position is set within a range in which a gap between a housing where the medium tray is provided and the medium tray is equal to or less than 25 mm, and wherein the first position is set outside the range in which the gap between the housing and the medium tray is equal to or less than 25 mm.

14. The computer-readable, non-transitory medium according to claim 11, wherein the motor is a stepping motor.

15. The computer-readable, non-transitory medium according to claim 11, wherein the medium tray is located at an initial position for a user to place the medium before start of conveyance of the medium, and wherein the torque of the motor is set to a torque smaller than the first torque when the medium tray is located at the initial position.

* * * * *